United States Patent [19]

Pelletier

[11] Patent Number: 4,497,489

Date of Patent: Feb. 5, 1985

[54] BOW AND LADDER AMUSEMENT DEVICE

[75] Inventor: Wilmer O. Pelletier, Portsmouth, N.H.

[73] Assignee: Bernice Pelletier, Portsmouth, N.H.

[21] Appl. No.: 407,251

[22] Filed: Aug. 11, 1982

[51] Int. Cl.[3] ..... A63F 9/08

[52] U.S. Cl. ..... 273/158

[58] Field of Search ..... 273/158; D21/106

[56] References Cited

U.S. PATENT DOCUMENTS

| | | | |
|---|---|---|---|
| D. 225,425 | 12/1972 | Brown | 273/158 X |
| D. 258,601 | 3/1981 | Smallwood | 273/158 X |
| 428,455 | 5/1890 | Charshee | 273/158 |
| 1,707,813 | 4/1929 | Nichols | 273/158 |
| 1,726,952 | 9/1929 | Gonzales | 273/158 |
| 3,441,282 | 4/1969 | Lewis | 273/158 |
| 4,000,901 | 1/1977 | Flores | 273/158 |

FOREIGN PATENT DOCUMENTS

| | | | |
|---|---|---|---|
| 759912 | 12/1933 | France | 273/158 |

OTHER PUBLICATIONS

"Creative Puzzles of the World", by Van Delft and Botermans, copyright 1978, publ. by Harry N. Abrams, N.Y., pp. 109, 153 and 154.

*Primary Examiner*—Anton O. Oechsle

*Attorney, Agent, or Firm*—Weingarten, Schurgin, Gagnebin & Hayes

[57] ABSTRACT

A bow and ladder toy or game is provided in which an elliptically-shaped bow is moved from the top of the ladder to the bottom rung of the ladder and back up, with the purpose of the game being to pass the bow through and around the ladder structure such that the bow surrounds the lowest rung of the ladder. The bow is then passed around and through the ladder structure such that the bow is completely removed.

9 Claims, 9 Drawing Figures

BOW AND LADDER AMUSEMENT DEVICE

FIELD OF INVENTION

This invention relates to games, toys, and amusement devices, and more particularly to a puzzle in which a continuous member defining an enclosed space is manipulated with respect to a ladder structure such that the continuous structure surrounds the lowest rung of the ladder.

BACKGROUND OF THE INVENTION

Many games and puzzles have been provided in which solutions are not immediately obvious to the player of the game. Such games include so-called chinese puzzles in which the manner of assembly of the final structure is not immediately apparent. The complexity of such games or toys varies greatly in the number of solutions possible for a given puzzle. In general there are games in which there is only one possible method of arriving at a solution through manipulation, whereas some puzzles are amenable to a number of possible solutions to arrive at the final structure desired. Rubik's Cube ®, in which individual squares having predetermined colors are arranged in a predetermined fashion, is one such puzzle in which multiple solutions are possible.

SUMMARY OF THE INVENTION

The subject invention involves the use of a bow in the form of an ellipse having an open and completely enclosed center region, and a ladder structure through and about which the bow is moved from the top of the ladder to the bottom rung of the ladder, and then back up. The purpose of the game is to pass the bow through the ladder structure and about it such that the bow finally surrounds the lowest rung of the ladder. A second part of the puzzle is once having the bow completely surrounding the lowest rung, the bow is then passed up through the ladder structure in a series of moves such that the bow is completely removed from the ladder structure. One of the salient features of the subject game or puzzle is that while there are no openings in either the bow or in the ladder structure, the bow, through a series of moves, can be made to completely surround any of the rungs of the ladder.

In order to accompish this, there is a sequential progression of steps in which the bow is inserted through and around various circular links which form portions of the ladder structure, thereby to be able to move the bow down the ladder structure. Once the bow has reached the lowest rung of the ladder structure, it may then be moved upwards through the ladder structure again through a series of steps until the bow is completely removed from the ladder structure. The series of steps necessary to remove the bow from the lowest rung are not necessarily the same set of steps, performed in reverse, which were used to pass the bow through the ladder structure down to the lowest rung.

In one embodiment, the ladder is constructed from a series of U-shaped members which have continuous rings at the topmost portion of the upstanding portions of the U-shaped member, with the rings forming links. Each U-shaped member is connected to the member immediately above by virtue of passing the bottom portion of the U-shaped member forming the rung through the circular links of the member immediately below. The topmost rung is formed by a barbell member has a central rung and fully enclosed circular end pieces which have diameters greater than the diameters of the links of the topmost U-shaped member through which they pass.

The ladder structure thus formed may be composed of any number of U-shaped members, each having a pair of links at the topmost portions of the upstanding portions of the U-shaped member, and each having a lower portion which is generally horizontal in orientation and forms a lower rung of the ladder structure.

While there may indeed be many solutions to the subject game or puzzle, one solution is presented hereinafter in which the bow is slipped around and through various links, rungs, and the barbell member.

BRIEF DESCRIPTION OF THE DRAWINGS

These and other features of the subject invention will be better understood in connection with the following description taken in conjunction with the drawings of which.

DETAILED DESCRIPTION

Figure 1:
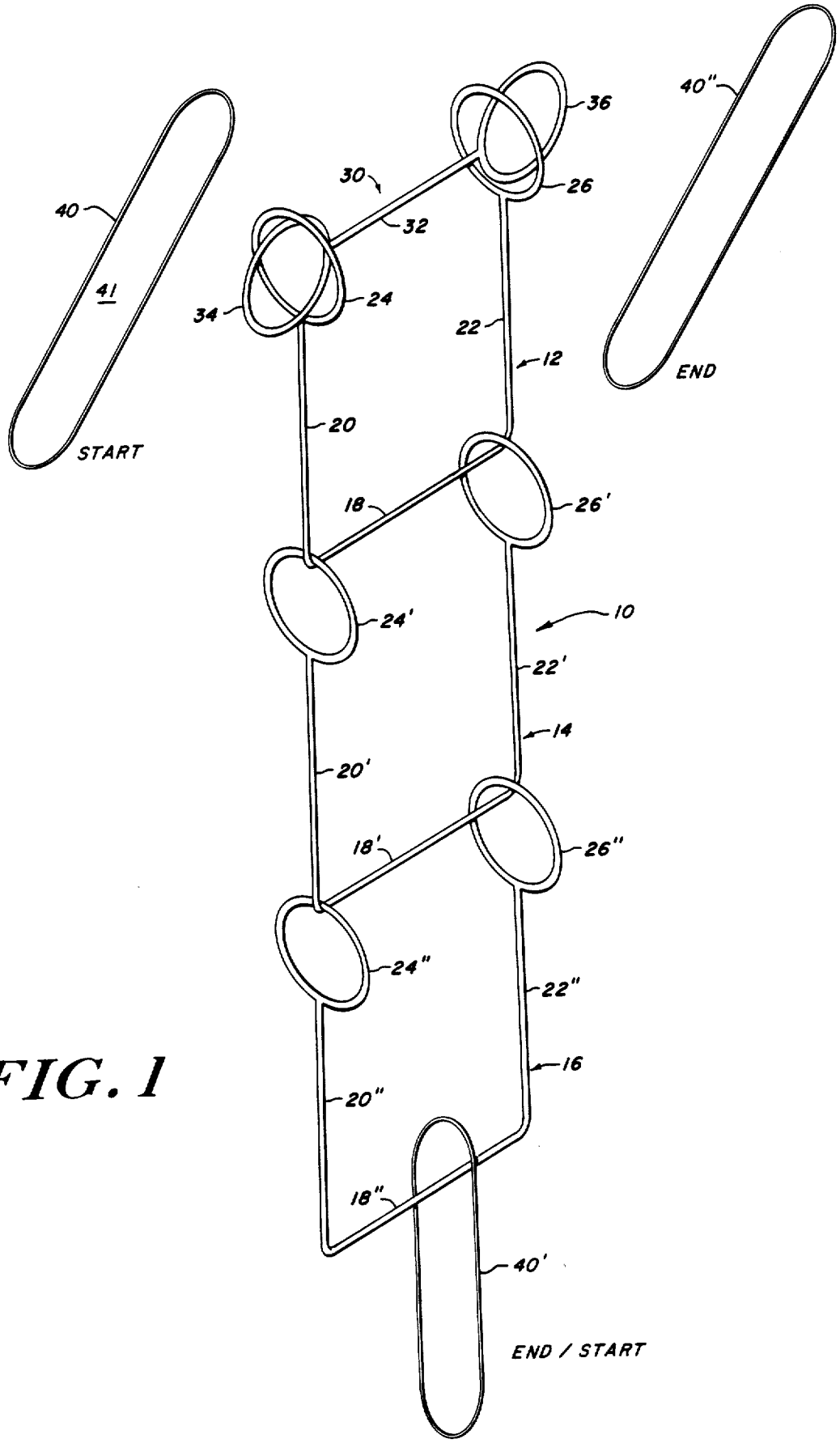
FIG. 1 is a diagrammatic representation of the ladder structure including a diagrammatic illustration of the bow at a START position and an END position completely surrounding the lower rung of the ladder which also forms the START position for the removal of the bow from the ladder structure.

Referring now to FIG. 1, a ladder structure 10 includes a number of U-shaped members 12, 14 and 16, each of which comprise a generally horizontally running rung 18, upstanding portions 20 and 22, and links 24 and 26, generally of a continuous circular nature at the ends of respective upstanding members 20 and 22. The corresponding structures on the lower U-shaped members are designated by the prime, double prime nomenclature noted in FIG. 1. The topmost rung includes the barbell member 30 which generally includes a horizontal rung 32 and circular end pieces 34 and 36, with the diameter of the end pieces being slightly larger than the diameters of links 24 and 26. In this manner the barbell member is retained within the ladder structure as the topmost rung.

A bow 40 is provided in the form of an uncollapsible narrow ellipse or oval without ears which provides an open, completely enclosed central region 41. The shape of the bow is not critical as long as this completely enclosed central region is formed. Bow 40 is moved through the ladder structure in the steps described in connection with FIGS. 1 through 5 until such time as it encircles rung 18'' as illustrated at 40'. This describes the end condition for the first portion of the game or puzzle and serves as the start position in the second portion of the game or puzzle in which the bow, at position 40', is worked up through the ladder structure until it is completely removed as illustrated 40''.

Figure 2:
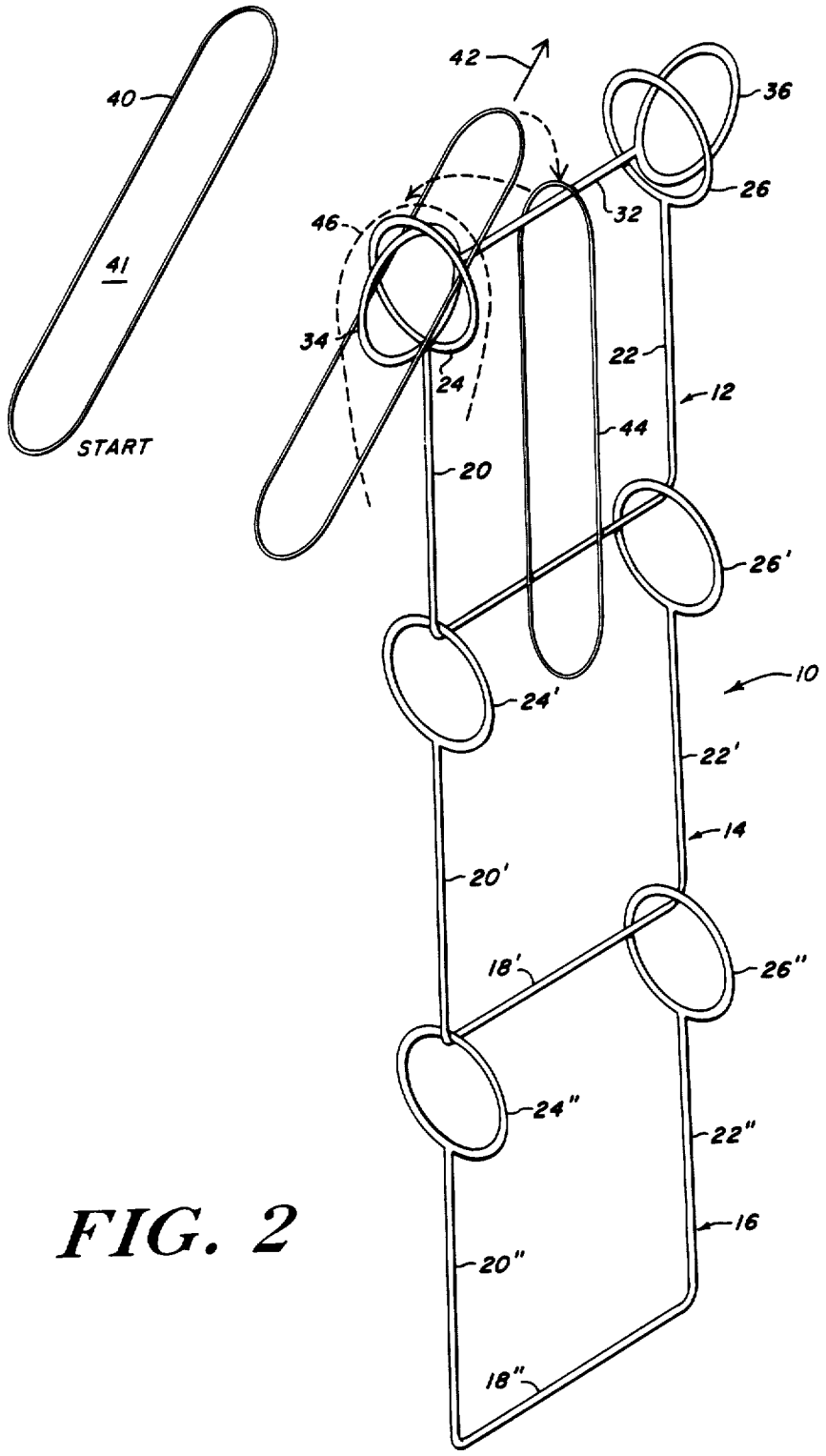
FIGS. 2 through 5 illustrate steps involved in passing the bow through the ladder structure such that the bow completely encircles the bottom rung of the ladder structure; and, FIGS. 6 through 9 illustrate the steps involved in the removal of the bow from encircling the lowermost rung to a position wherein the bow is completely removed from the ladder structure.
Figure 3:
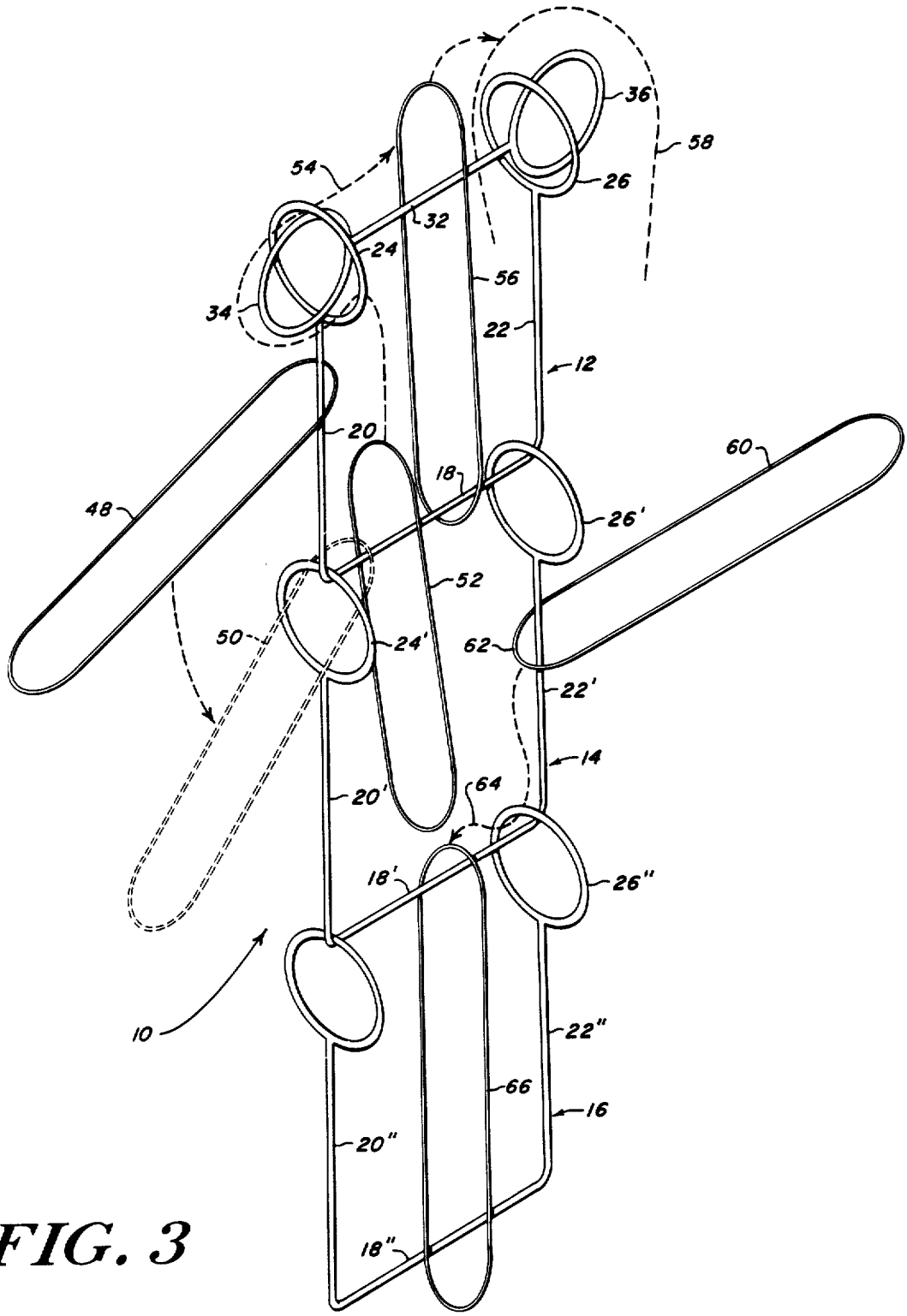
Figure 4:
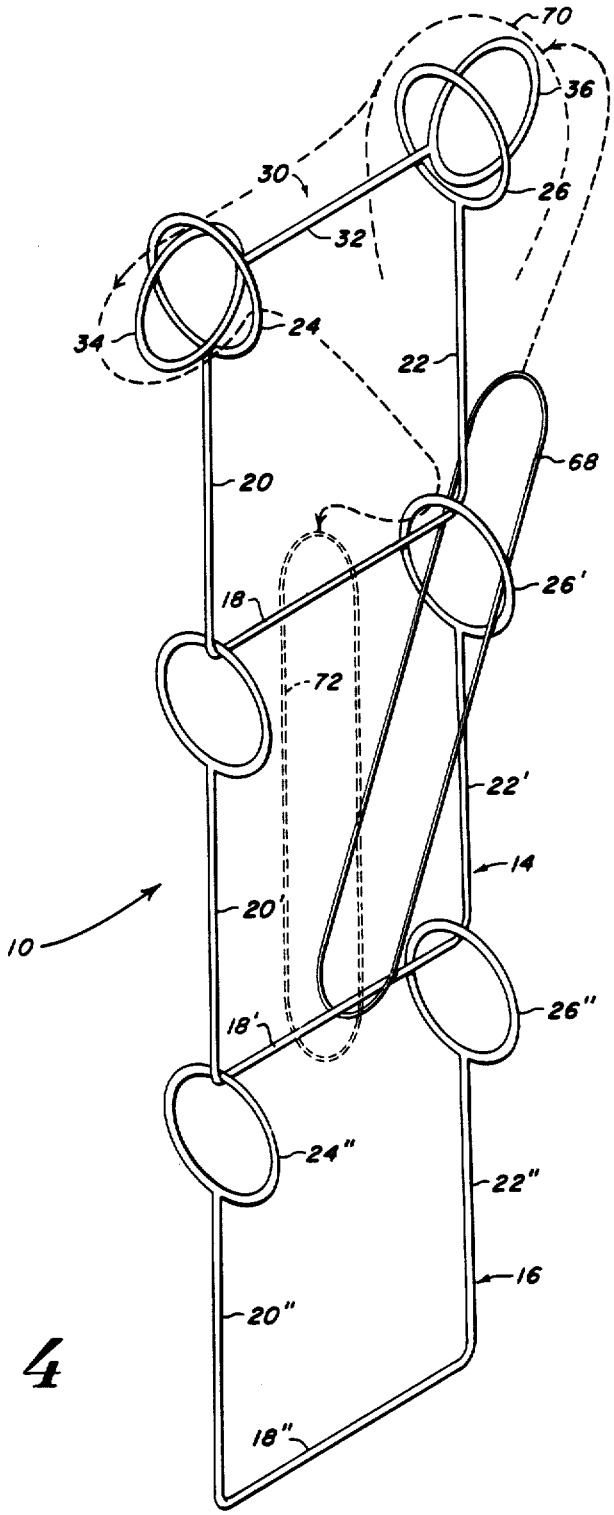

Referring now to FIG. 2 and one possible solution for the puzzle, in order to start the game, the bow is maintained completely separate from the ladder structure as illustrated at 40. In the first step, the bow is inserted through link 24. The end of the bow which passes through the link, is passed over barbell end 34 and pulled through in the direction of arrow 42 such that the bow encircles rung 32 as illustrated at 44. As a next step, the bow is passed over barbell end 34 and link 24 as illustrated at 46 and is run down vertically extending portion 20 and U-shaped member 12. As illustrated in FIG. 3 at 48, the end 50 of the bow is passed through link 24' such that the bow encircles rung 18 as illustrated at 52. In the next step the bow is inserted back through link 24 from the inside, out and is passed over barbell end 34 as illustrated by dotted line 54. The result is illustrated at 56 in which the bow encircles both rung 18 and rung 32. As a next step, the bow is then passed over both link 26 and barbell end 36 as illustrated at 58 such that as illustrated at 60, the bow completely surrounds upstanding member 22'. As a next step, starting from the outside position with respect to link 26'', the end of the bow 62 is passed through link 26'' as illustrated by arrow 64 such that the bow now surrounds rung 18' as illustrated at 66. This is accomplished by passing the bow from the outside of link 26'' to the inside of this link. As illustrated in FIG. 4 at 68, the bow is then passed through link 26' from the inside of this link to theoutside. As illustrated at 70, the end of the bow is then passed over link 26 and barbell end 36. This end of the bow is then inserted through the opposing link, e.g. link 24, and around barbell end 34. Thereafter, the bow is inserted back through link 26' from the outside to the inside at which point the bow completely encircles rung 18' and rung 18. This is illustrated by dotted outline 72.

Figure 5:
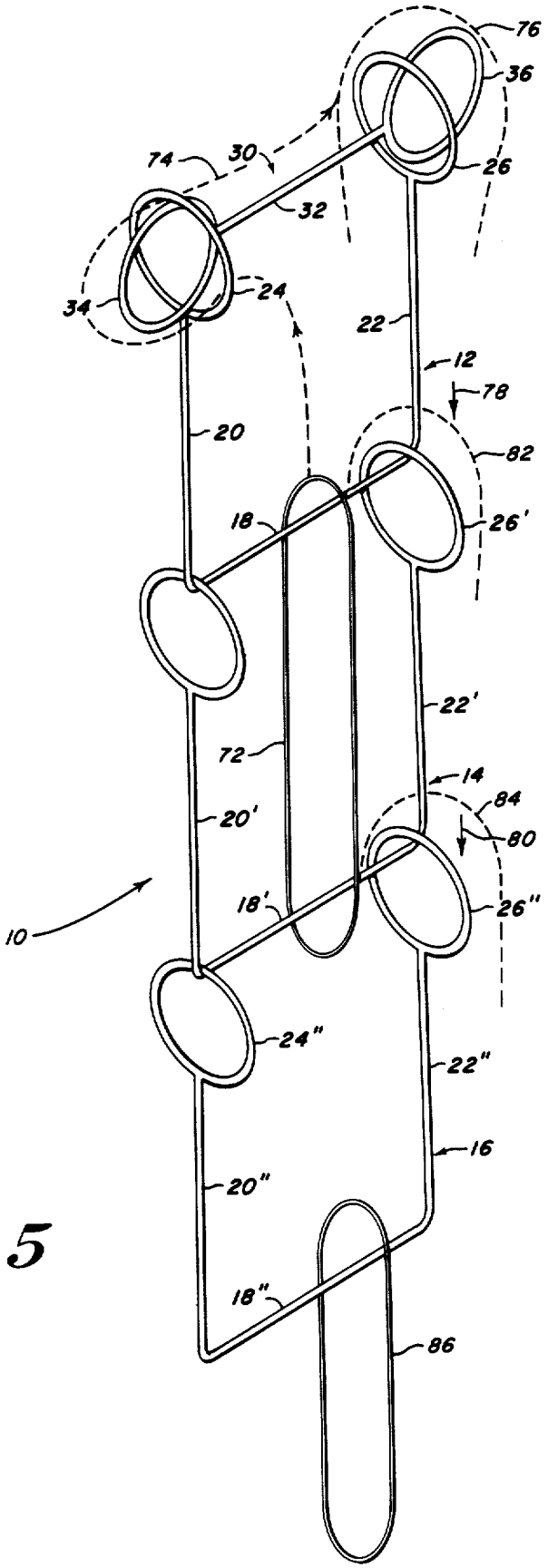

As illustrated in FIG. 5, the bow at position 72 surrounding rungs 18 and 18' is passed back through link 24 from the inside, out and over barbell end 34 as illustrated. It is then brought back through link 24 as illustrated by arrow 74, at which point the bow now encircles rungs 32, 18, and 18' (not illustrated). Then, as illustrated at 76, the end of the bow is passed over link 26 and barbell end 36, it is moved downwardly as illustrated by arrow 78 and is passed over link 26'. The bow is moved downwardly as illustrated by arrow 80, so that it passes over link 26'', with the passage over the respective links as illustrated at 82 and 84 respectively. The result is that the bow, illustrated at 86, now completely encircles only rung 18'', which ends the first portion of the subject game or puzzle.

Figure 6:
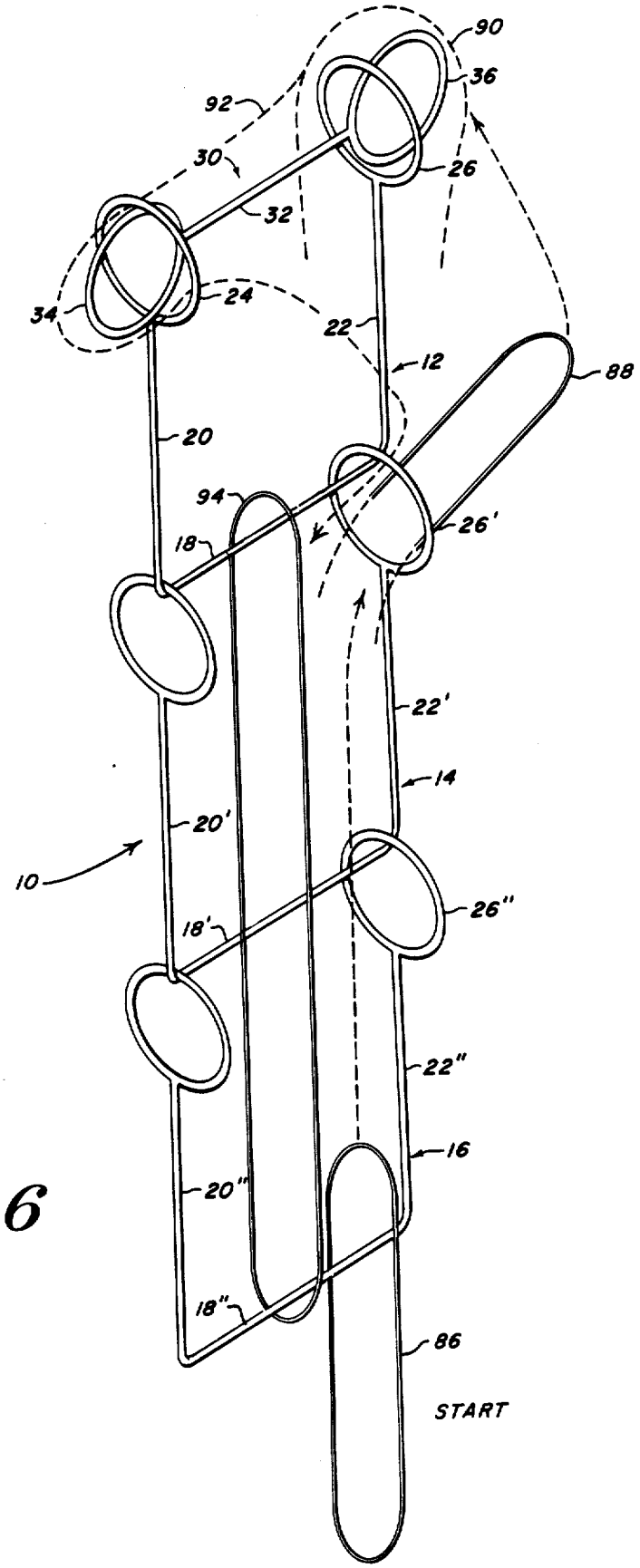

Referring now to FIG. 6, the remainder of the game may be played by starting at the position illustrated at 86, passing the end of the bow from the inside, out through link 26' as illustrated at 88. Thereafter, the end of the bow is passed over link 26 and barbell end 36 as illustrated at 90. Thereafter as illustrated by arrow 92, the end of the bow is passed through link 24 from the inside, out. The bow is then passed around barbell end 34, and back through link 24. Thereafter, this end is inserted from the outside, in through link 26' such that the bow as illustrated at 94 now encircles rung 18 and 18''. For purposes of clarity, the bow as illustrated at 94 (FIG. 6) is shown to be sufficiently elongated to encircle both rung 18 and rung 18''.

Figure 7:
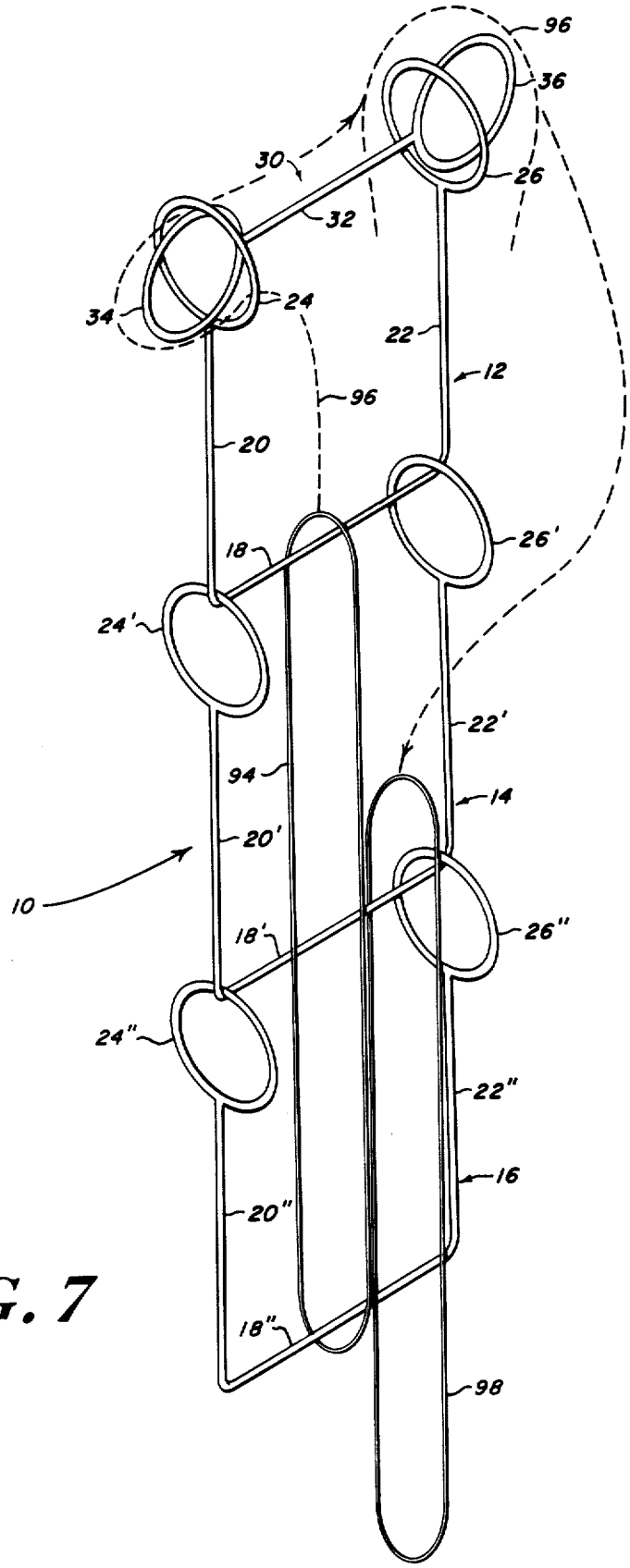

Referring now to FIG. 7, with the bow at position 94, the end of the bow is moved in the direction of arrow 96 from the inside, out through link 24, around barbell end 34, and back through link 24 from the outside, in. Thereafter, the bow is passed over link 26 and barbell end 36 as illustrated at 96. The bow is then moved downwardly so that it completely encircles rung 18' as illustrated at 98.

Figure 8:
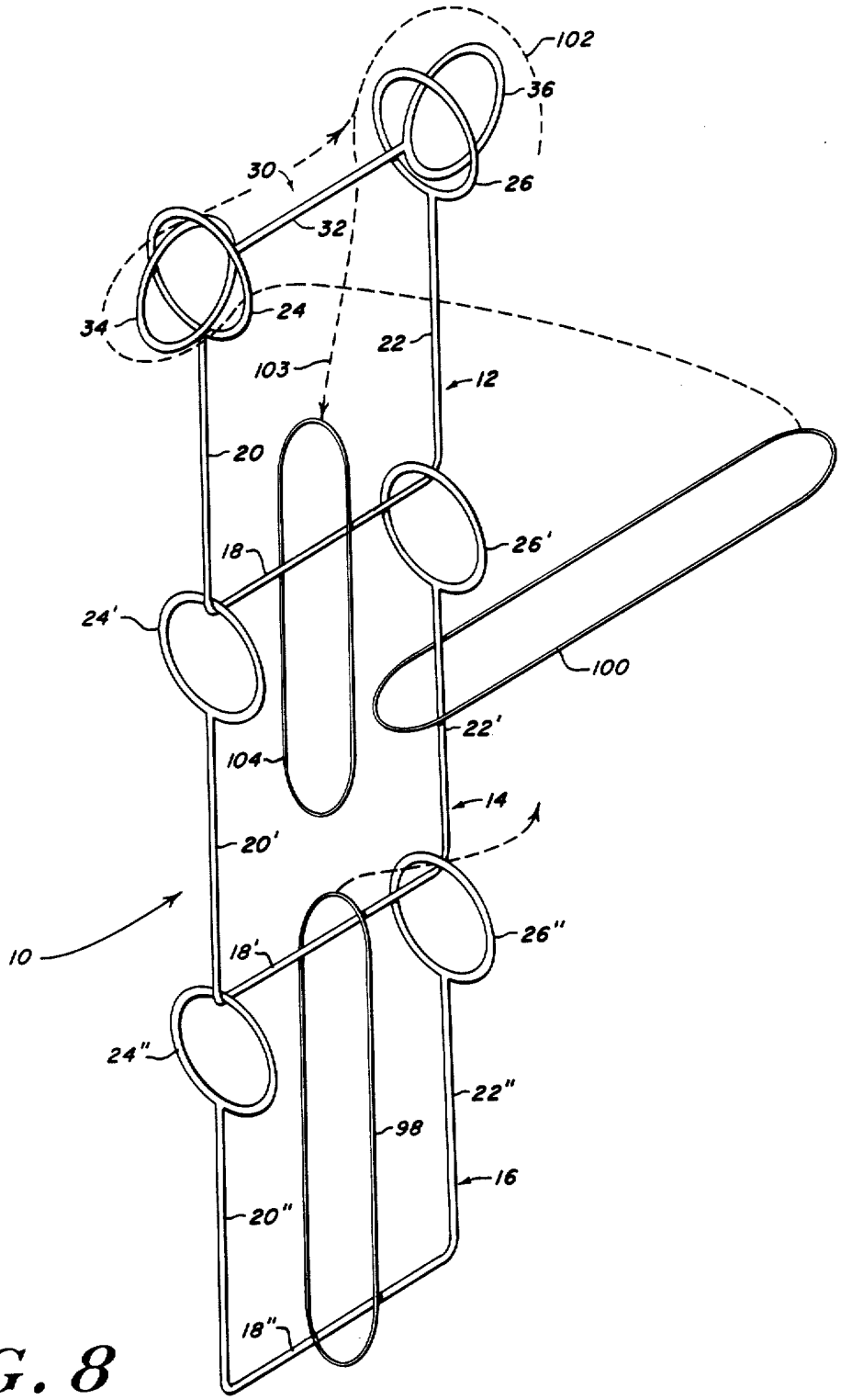

Referring now to FIG. 8, the bow at position 98 is passed through link 26'' from the inside, out as illustrated, such that the bow now encircles upstanding member 22' as illustrated at 100. The end of the bow is then passed through link 24 from the inside, out, around barbell end 34, and back through link 24 from the outside, in. Thereafter, the end of the bow is passed over link 26 and barbell end 36 as illustrated at 102. The bow is then moved downwardly as illustrated at 103 such that it now encircles rung 18 as illustrated at 104.

Figure 9:
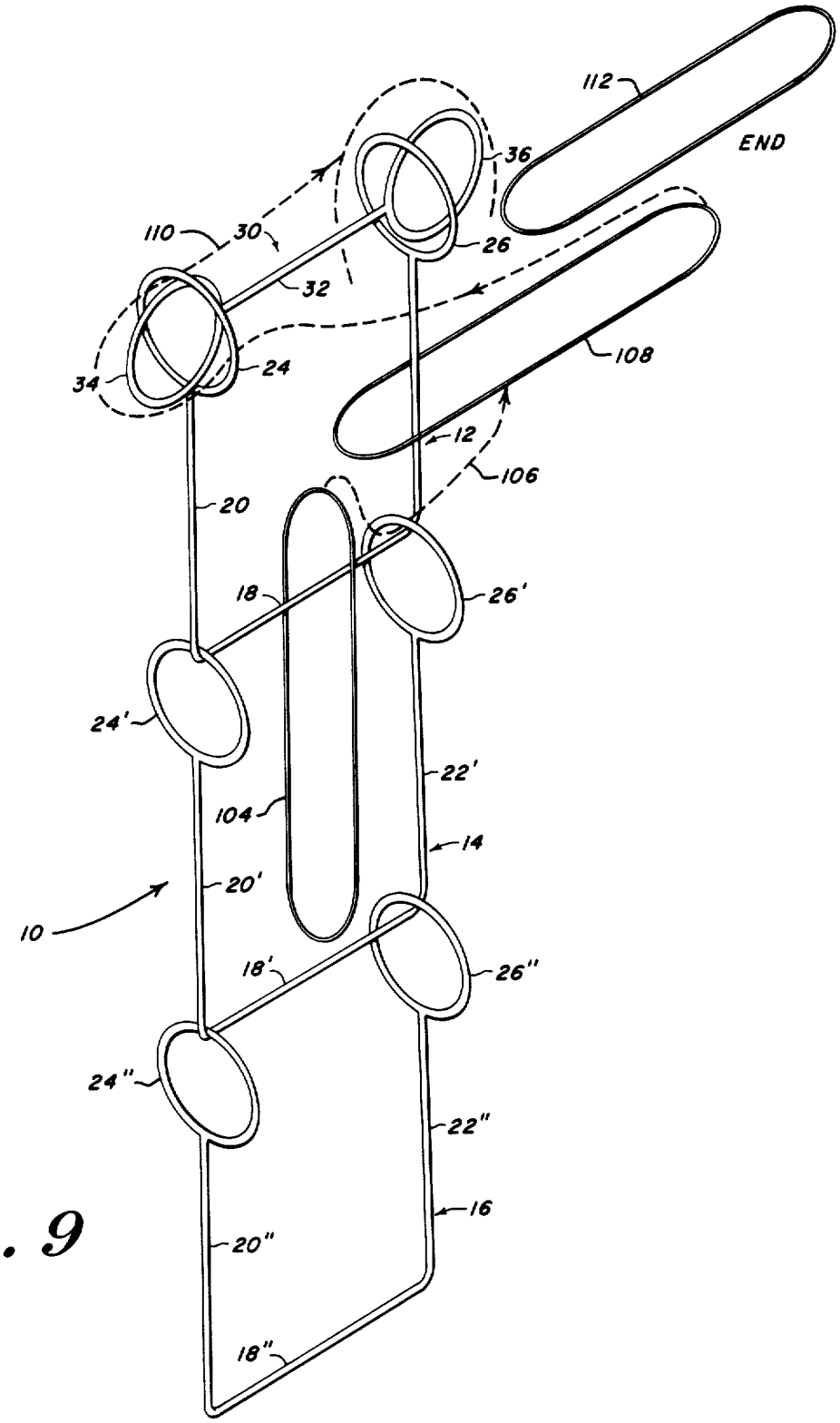

As illustrated in FIG. 9, with the bow in position 104, the end of the bow is passed through link 26' from the inside, out as illustrated by arrow 106, such that the bow completely encircles upstanding member 22 as illustrated at 108. Thereafter, the end of the bow is passed through link 24 and over barbell end 34 from whence it is reinserted through link 24 from the outside, in. This movement is illustrated by arrow 110. The end of the bow is then passed over link 26 and barbell end 36 to completely remove the bow from the ladder structure as illustrated at 112.

The foregoing describes one possible solution for the ladder game as presented for illustration purposes only.

It will be appreciated the length of the bow, vis a vis the vertical rise of the ladder structure is such that it is longer than the distance between the rungs of the ladder. In other words, the bow desirably extends from the lowest rung, past the middle rung, the above an upper rung. The bow preferably should not be longer than the height of the completed ladder.

The ladder construction is such that the U-shaped members may be integral and formed in the manner of a chain by known methods. It will also be appreciated that the length of the barbell rung is shorter than the spacing between the associated links such that barbell ends are retained by the opposed links of the uppermost U-shaped member.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. An amusement device comprising in combination:

a ladder structure having rungs and links in the form of rings having a predetermined diameter, said rungs and links being permanently and rigidly attached, with said links surrounding all but the bottom rung, and a barbell member through the links adjacent the top of the ladder structure, said barbell member having rings at either end thereof, the diameters of the barbell rings being larger than those of the links at the top of the ladder structure; and an elongated earless noncollapsible bow having a completely enclosed unobstructed center region, said bow having maximum width which permits the passage of the bow completely through any of said links and a maximum length essentially that of the length of the unobstructed center region.

2. The amusement device of claim 1 wherein at least one of the rungs of the ladder structure includes a U-shaped member having rings at the ends of the upstanding portions of the U-shaped member, said rings forming a pair of said links.

3. The amusement device of claim 2 wherein said barbell member includes a central bar and rings at either end thereof.

4. The amusement device of claim 3 wherein the diameter of the rings at either end of said central bar is greater than the diameters of the rings of said U-shaped member.

5. The amusement device of claim 1 wherein said bow is continuous.

6. The amusement device of claim 1 wherein said bow is elliptical.

7. The amusement device of claim 1 wherein said bow is an oval.

8. The amusement device of claim 1 wherein said ladder structure has four rungs, said barbell member forming one of said rungs.

9. The amusement device of claim 2 wherein all rungs but the top rung formed by said barbell member include said U-shaped member.

* * * * *